US010627753B2

(12) United States Patent
Tsubouchi et al.

(10) Patent No.: US 10,627,753 B2
(45) Date of Patent: Apr. 21, 2020

(54) HEATER, IMAGE FORMING APPARATUS, AND MANUFACTURING METHOD OF HEATER

(71) Applicant: Toshiba Lighting & Technology Corporation, Yokosuka-shi, Kanagawa-ken (JP)

(72) Inventors: Akio Tsubouchi, Yokosuka (JP); Kentaro Kimura, Yokosuka (JP); Yoshitatsu Matsui, Yokosuka (JP); Takanobu Ueno, Yokosuka (JP)

(73) Assignee: Toshiba Lighting & Technology Corporation, Yokosuka-shi, Kanagawa-ken (JP)

( * ) Notice: Subject to any disclaimer, the term of this patent is extended or adjusted under 35 U.S.C. 154(b) by 418 days.

(21) Appl. No.: 15/457,415

(22) Filed: Mar. 13, 2017

(65) Prior Publication Data

US 2017/0371281 A1 Dec. 28, 2017

(30) Foreign Application Priority Data

Jun. 24, 2016 (JP) ..... 2016-125762

(51) Int. Cl.
*G03G 15/20* (2006.01)

(52) U.S. Cl.
CPC ..... *G03G 15/2053* (2013.01)

(58) Field of Classification Search
CPC ..... G03G 15/2053; G03G 2215/2035; G03G 15/2042; G03G 15/2064; G03G 15/55; G03G 15/80; G03G 15/2057; G03G 15/206; G03G 2215/0132; G03G 2215/2016; G03G 2215/2048; G03G 2215/2058; G03G 2215/2061; G03G 2215/2064; H05B 3/0095; H05B 1/0241; H05B 2203/007; H05B 2203/011; H05B 2203/016; H05B 3/06; H05B 3/0019; H05B 3/0028
USPC ..... 219/216, 539, 541, 388, 469, 486, 542
See application file for complete search history.

(56) References Cited

U.S. PATENT DOCUMENTS

2001/0032835 A1* 10/2001 Murooka ..... G03G 15/2064 219/216

FOREIGN PATENT DOCUMENTS

| | | | | |
|---|---|---|---|---|
| JP | H11-040319 A | | 2/1999 | |
| JP | 2000-044344 A | | 2/2000 | |
| JP | 2004179556 A | * | 6/2004 | ..... B23K 26/364 |

OTHER PUBLICATIONS

English translation of JP-2004179556-A (Year: 2004).*

* cited by examiner

*Primary Examiner* — Serkan Akar
*Assistant Examiner* — Chris Q Liu
(74) *Attorney, Agent, or Firm* — Banner & Witcoff, Ltd.

(57) ABSTRACT

A heater according to an embodiment includes a substrate that is formed of a heat resistant insulating material, a heating resistor that is provided on the substrate, a conductor that is provided on the substrate and that is electrically connected to the heating resistor, and a coating film that covers the heating resistor and the conductor. A plurality of groove portions are arranged on an end surface of the substrate along an outer periphery of the substrate, and a coefficient $A=100\times D/(T\times P)$ satisfies $0.4\leq A\leq 0.9$ where T [μm] is the thickness of the substrate, D [μm] is the depth of the groove portion in a thickness direction of the substrate, and P [μm] is a pitch between the groove portions.

5 Claims, 4 Drawing Sheets

| | CASE WHERE A<0.4 | CASE WHERE 0.4≤A≤0.9 |
|---|---|---|
| MAXIMUM VALUE [mm] | 8.91 | 8.81 |
| AVERAGE VALUE [mm] | 8.79 | 8.76 |
| MINIMUM VALUE [mm] | 8.76 | 8.74 |
| (MAXIMUM VALUE) - (MINIMUM VALUE) [mm] | 0.15 | 0.07 |

FIG.5

| | CASE WHERE $0.4 \leq A \leq 0.9$ | CASE WHERE $0.9 < A$ |
|---|---|---|
| MAXIMUM VALUE [MPa] | 456.9 | 408.6 |
| AVERAGE VALUE [MPa] | 422.1 | 364.3 |
| MINIMUM VALUE [MPa] | 367.9 | 329.6 |
| (MAXIMUM VALUE) - (MINIMUM VALUE) [MPa] | 89.0 | 79.0 |

FIG.6

| | CASE WHERE $0.4 \leq A \leq 0.9$ | CASE WHERE $0.9 < A$ |
|---|---|---|
| MAXIMUM VALUE [sec] | 4.28 | 3.31 |
| AVERAGE VALUE [sec] | 3.71 | 2.91 |
| MINIMUM VALUE [sec] | 2.87 | 2.49 |
| (MAXIMUM VALUE) - (MINIMUM VALUE) [sec] | 1.41 | 0.82 |

HEATER, IMAGE FORMING APPARATUS, AND MANUFACTURING METHOD OF HEATER

CROSS-REFERENCE TO RELATED APPLICATIONS

This application is based upon and claims the benefit of priority from Japanese Patent Application No. 2016-125762, filed Jun. 24, 2016, the entire contents of which are incorporated herein by reference.

FIELD

An embodiment described herein relates to a heater, an image forming apparatus, and a manufacturing method of a heater.

BACKGROUND

In an image forming apparatus such as a copying machine, a heater is used to fix a toner that is adhered to a medium such as a recording sheet. In such a heater, for example, a ceramic substrate is provided with a heating resistor. In a manufacturing process of a heater, groove lines (split line) are formed on a flat plate-shaped base material through groove processing using a laser scribing technique and the base material is split into a plurality of heaters along the groove lines thereby manufacturing heaters with desired external dimensions.

As one of methods of increasing the thermal efficiency of a heater, there is a method of decreasing the thickness of a substrate. Particularly, in a case of a ceramic substrate, as the thickness of the substrate decreases, micro cracking starting from a groove portion, which is split along a groove line, becomes more likely to occur while causing a decrease in mechanical strength and thermal shock strength of the substrate. Therefore, a technique of suppressing a decrease in mechanical strength of the substrate by forming a glass film on an end surface of the substrate is known.

However, the above-described manufacturing process of a heater has a problem that the productivity of a heater decreases since a processing process of forming a glass film on an end surface of a substrate after a base material is split into a plurality of heaters, is added.

Therefore, an object of an exemplary embodiment is to provide a heater, an image forming apparatus, and a manufacturing method of a heater with which it is possible to suppress a variation in external dimension of a substrate and to suppress a decrease in mechanical strength and thermal strength of the substrate without adding a processing process.

BRIEF DESCRIPTION OF DRAWINGS

FIG. 5 is a diagram for explaining a relationship between the deflective strength and the coefficient A.

FIG. 6 is a diagram for explaining a relationship between thermal shock strength and the coefficient A.

DESCRIPTION OF EMBODIMENTS

Figure 1:
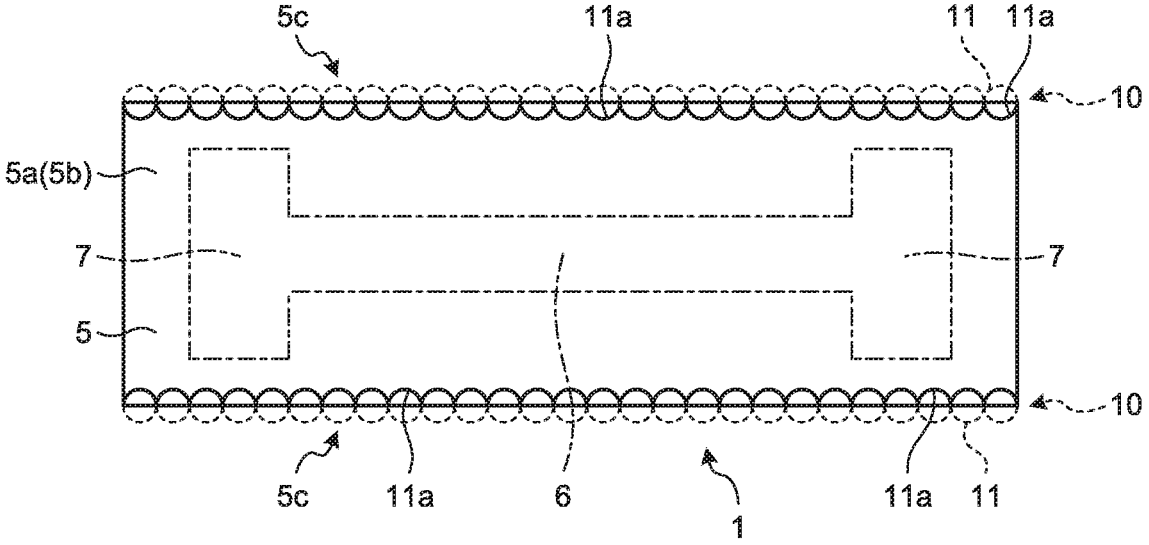
FIG. 1 is a plan view illustrating a heater according to an embodiment.

A heater 1 according to an embodiment described below includes a substrate 5, a heating resistor 6, a conductor 7, and a protection film 8 as a coating film. The substrate 5 is formed of a heat resistant insulating material. The heating resistor 6 is provided on the substrate 5. The conductor 7 is provided on the substrate 5. The conductor 7 is electrically connected to the heating resistor 6. The protection film 8 covers the heating resistor 6 and the conductor 7. A plurality of groove portions 11*a* are arranged on an end surface 5*c* of the substrate 5 along an outer periphery of the substrate 5. A coefficient $A=100\times D/(T\times P)$ satisfies $0.4\leq A\leq 0.9$ where T [μm] is the thickness of the substrate 5, D [μm] is the depth of the groove portion 11*a* in a thickness direction of the substrate 5, and P [μm] is a pitch between the plurality of groove portions 11*a*.

In addition, a copying machine 100 as an image forming apparatus according to the embodiment described below includes the heater 1 and a pressure roller 203. The heater 1 heats a recording sheet M as a medium. The pressure roller 203 pressurizes the recording sheet M which is heated by the heater 1. The copying machine 100 fixes a toner that is adhered to the recording sheet M by using the heater 1 and the pressure roller 203.

A manufacturing method of the heater 1 according to the embodiment described below includes a forming process, a groove portion forming process, and a splitting process. In the forming process, the heating resistor 6 and the conductor 7, which is electrically connected to the heating resistor 6, are formed on the substrate 5, which is formed of a heat resistant insulating material, and the heating resistor 6 and the conductor 7 are covered with the protection film 8. In the groove portion forming process, a groove line 10, in which a plurality of circular groove portions 11 are arranged, is formed by irradiating the substrate 5 with laser light. In the splitting process, the substrate 5 is split along the groove line 10. In the groove portion forming process, the plurality of circular groove portions 11 in each of which a coefficient $A=100\times D/(T\times P)$ satisfies $0.4\leq A\leq 0.9$ are formed where T [μm] is the thickness of the substrate 5, D [μm] is the depth of the circular groove portion 11 in the thickness direction of the substrate 5, and P [μm] is a pitch between the plurality of circular groove portions 11.

EMBODIMENT

Figure 2:
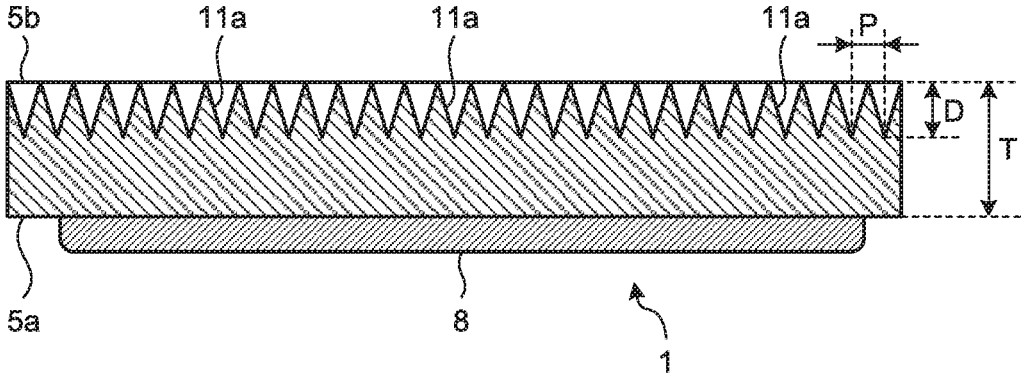
FIG. 2 is a side view illustrating the heater.

Hereinafter, the heater according to the embodiment will be described with reference to the drawings. FIG. 1 is a plan view illustrating the heater according to the embodiment. FIG. 2 is a side view illustrating the heater according to the embodiment. As illustrated in FIGS. 1 and 2, the heater 1 according to the embodiment includes the substrate 5, the heating resistor 6, the conductor 7, and the protection film 8 as a coating film. The heater 1 according to the embodiment is used as a so-called fixing heater which fixes a toner onto a recording sheet as a medium in an image forming apparatus, for example.

The substrate 5 is formed of a heat resistant insulating material such as a ceramic and is formed to have a long flat plate-like shape. The substrate 5 is formed of a ceramic such as alumina, aluminum nitride, or silicon nitride. However, the material of the substrate 5 is not limited to the ceramic. The substrate 5 is formed to have a thickness T of approximately 500 [μm] to 1000 [μm].

The heating resistor 6 is provided on one main surface 5*a* in the thickness direction of the substrate 5. The heating resistor 6 is formed by printing a conductive paste, which contains silver and a palladium-based alloy as a main component through screen printing, and by firing the conductive paste. The conductor 7 is provided on the main surface 5*a* of the substrate 5 and is electrically connected to the heating resistor 6. Power from an external power source (not shown) is supplied to the heating resistor 6 via the conductor 7. The heater 1 according to the embodiment includes one heating resistor 6. However, a plurality of heating resistors 6 may be connected to each other in parallel, for example. In addition, one heating resistor 6 may be formed into a tortuous shape while being folded back at both ends of the substrate 5.

The protection film 8 covers the heating resistor 6 and the conductor 7. As the protection film 8, for example, a glass film is used. Since the protection film 8 covers the heating resistor 6 and the conductor 7, the voltage endurance and the wear resistance of the heater 1 are improved.

Groove Portion of Heater

The above-described heater 1 is manufactured by splitting the base material into a plurality of pieces along the groove line 10 after forming the plurality of circular groove portions 11 on a flat plate-shaped base material (not shown) through a groove portion forming process (specifically, laser scribing process), that is, after forming the groove line 10 (refer to FIG. 1) in which the plurality of circular groove portions 11 are linearly arranged. Therefore, with the other main surface 5*b* of the substrate 5 of each heater 1 made from the base material being irradiated with a laser, the plurality of groove portions 11*a*, each of which has a conical section, are formed in a direction from the other main surface 5*b* to the one main surface 5*a*, that is, the plurality of groove portions 11*a* are formed to be arranged at predetermined pitches. The diameter (laser spot diameter) of the groove portion 11*a* on the main surface 5*b* of the substrate 5 is set to, for example, approximately 20 [μm] to 50 [μm]. The groove portion 11*a* does not penetrate the substrate 5 in the thickness direction and is formed on the main surface 5*b* of the substrate 5. The depth of the groove portion 11*a* in the thickness direction of the substrate 5 is set to be equal to or less than approximately 31% of the thickness of the substrate 5, for example.

Since the plurality of circular groove portions 11 are formed as described above, when the substrate 5 is split into the plurality of heaters 1 by being folded along the groove line 10, each of the circular groove portions 11, which are arranged along the groove line 10, is split and thus the plurality of groove portions 11*a*, each of which is groove portion with a semi-conical section, are formed on the end surface 5*c* of the substrate 5 of the heater 1. That is, in the embodiment, the groove portions 11*a* are groove portions, remaining on the end surface 5*c* of the substrate 5 of the heater 1 which are obtained, when the plurality of circular groove portions 11 are split along the groove line 10. As illustrated in FIGS. 1 and 2, the plurality of groove portions 11*a* are arranged on the end surface 5*c* of the substrate 5 along the outer periphery of the substrate 5. Note that, the sectional shape of the groove portion 11*a* is not limited to a semi-conical shape and the sectional shape may be a semi-cylindrical shape or may be a polygonal columnar shape.

In addition, in the heater 1, the coefficient $A=100\times D/(T\times P)$ satisfies $0.4\leq A\leq 0.9$ where T [μm] is the thickness of the substrate 5, D [μm] is the depth of the groove portion 11*a* in the thickness direction of the substrate 5, and P [μm] is the pitch between the plurality of groove portions 11*a*.

External Dimension of Heater

Figures 3, 4:
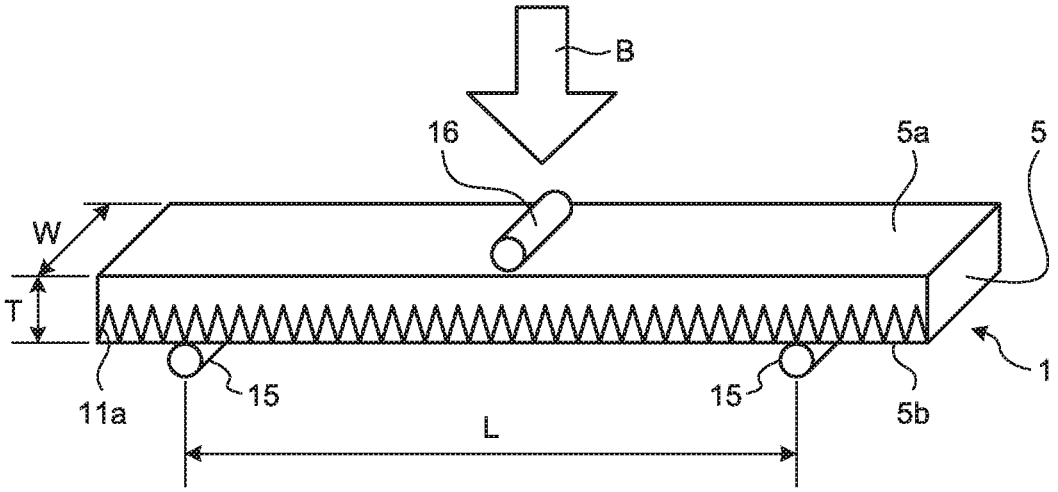
FIG. 3 is a diagram for explaining a relationship between an external dimension and a coefficient A.
FIG. 4 is a schematic view for explaining a bending test for calculating deflective strength.

FIG. 3 is a diagram for explaining a relationship between an external dimension and the coefficient A in relation to the heater 1 according to the embodiment. The width W [mm] of the heater 1, which is obtained by splitting the base material, in a lateral direction of the elongated substrate 5, was measured while setting a target value to 8.75 [mm]. Twenty heaters 1 were used as samples for measuring the external dimension for each of a case where $0.4\leq A\leq 0.9$ and a case where $A<0.4$.

As illustrated in FIG. 3, in a case where the coefficient A satisfies $A<0.4$, a difference, between the maximum value and the minimum value which corresponds to a variation in external dimension of the heater 1, was 0.15 [mm]. In a case where the coefficient A satisfies $0.4\leq A\leq 0.9$, a variation in external dimension of the heater 1, was 0.07 [mm] which is equal to or less than a half of that in a case where $A<0.4$. Accordingly, in a case where the coefficient A is less than 0.4, a variation in external dimension of the heater 1, which is obtained by splitting the base material along the groove line 10, tends to be increased, and thus the coefficient A being less than 0.4, is not preferable.

Deflective Strength of Heater

FIG. 4 is a schematic view for explaining a bending test for calculating deflective strength as mechanical strength in relation to the heater 1 according to the embodiment. FIG. 5 is a diagram for explaining a relationship between the deflective strength and the coefficient A in relation to the heater 1 according to the embodiment. Deflective strength F is a value indicating internal stress that arises within the heater 1, which is obtained by splitting the flat plate-shaped base material, when the heater 1 is broken during the bending test.

As illustrated in FIG. 4, the bending test was performed using a pair of columnar supporting members 15 and a columnar pressing member 16. The supporting members 15 support the heater 1 and serve as supporting points, and the pressing member 16 applies load to the heater 1 and serves as a load point. The pressing member 16 is disposed such that a central axis of the pressing member 16 is positioned on the center of an area between the pair of columnar supporting members 15. A load was applied to the heater 1 via the pressing member 16 from the main surface 5*a* side of the substrate 5 in a direction B orthogonal to the main surface 5*a* at a loading rate of 0.5 [mm/min].

The deflective strength F [MPa] was calculated by using $F=(3\times G\times L)/(2\times W\times T^2)$ where T [mm] is the thickness of the heater 1, W [mm] is the width of the elongated heater 1 in the lateral direction, L [mm] is a distance between the supporting points (distance between central axes of supporting members 15), and G[N] is the maximum load when the heater 1 is broken. Twenty heaters 1 were used as samples for measuring the deflective strength for each of a case where the coefficient A satisfies $0.4\leq A\leq 0.9$ and a case where the coefficient A satisfies $0.9<A$.

As illustrated in FIG. 5, in a case where the coefficient A satisfies $0.9<A$, the maximum value, the average value, and the minimum value of the deflective strength of the heater 1, were smaller than those in a case where $0.4\leq A\leq 0.9$, and it was not possible to secure suitable deflective strength. The mechanical strength of the heater 1 gradually decreases as the coefficient A increases, and it is difficult to secure suitable mechanical strength when the coefficient A exceeds 0.9. Therefore, the coefficient A exceeding 0.9 is not preferable.

Thermal Shock Strength of Heater

FIG. 6 is a diagram for explaining a relationship between thermal shock strength and the coefficient A in relation to the heater 1 according to the embodiment. Thermal shock is a phenomenon in which a substance is damaged due to impactive thermal stress accompanying a change in temperature when there is a sudden change in temperature of the substance with the substance being suddenly heated or cooled. The thermal shock strength refers to the strength of a substance against the thermal shock. Here, the thermal shock strength of the heater 1 is represented by using a time [sec] taken for the heater 1 to be broken due to thermal stress after an electric current is caused to continuously flow through the heater 1 at 1400 (W). Five heaters 1 were used as samples for measuring the thermal shock strength for each of a case where the coefficient A satisfies $0.4 \leq A \leq 0.9$ and a case where the coefficient A satisfies $0.9 < A$.

As illustrated in FIG. 6, in a case where the coefficient A satisfies $0.9 < A$, the maximum value, the average value, and the minimum value of the time [sec] corresponding to the thermal shock strength of the heater 1, were smaller than those in a case where $0.4 \leq A \leq 0.9$, and it was not possible to secure suitable thermal shock strength. The thermal shock strength of the heater 1 gradually decreases as the coefficient A increases, and it is difficult to secure suitable thermal shock strength when the coefficient A exceeds 0.9. Therefore, the coefficient A exceeding 0.9 is not preferable.

As described above, according to the heater 1 of the embodiment, since the coefficient A satisfies $0.4 \leq A \leq 0.9$, it is possible to suppress a variation in external dimension of the heater 1 (substrate 5) and is possible to suppress a decrease in deflective strength as mechanical strength and thermal shock strength as thermal strength of the heater 1 (substrate 5).

Manufacturing Method of Heater

The manufacturing method of the heater 1, which is configured as described above, will be described. The manufacturing method of the heater 1 includes the forming process, the groove portion forming process, and the splitting process. In the forming process, the heating resistor 6 and the conductor 7, which is electrically connected to the heating resistor 6, are formed on the substrate 5, which is formed of a heat resistant insulating material. In addition, in the forming process, the heating resistor 6 and the conductor 7 are covered with the protection film 8. In the groove portion forming process, the groove line 10, in which the plurality of circular groove portions 11 are arranged, is formed by irradiating the substrate 5 with laser light. In the splitting process, the substrate 5 is split along the groove line 10. In the groove portion forming process, the plurality of circular groove portions 11, in each of which the coefficient $A=100 \times D/(T \times P)$ satisfies $0.4 \leq A \leq 0.9$, are formed where T [μm] is the thickness of the substrate 5, D [μm] is the depth of the plurality of circular groove portions 11 in the thickness direction of the substrate 5, and P [μm] is a pitch between the plurality of circular groove portions 11.

The order, in which the processes included in the manufacturing method of the heater 1, are executed is not limited to the above-described order. For example, the groove portion forming process, the forming process, and the splitting process may be executed in this order so that the heating resistor 6 and the conductor 7 are covered with the protection film 8, and the substrate 5 is split along the groove line 10 after the groove line 10, in which the plurality of circular groove portions 11 are arranged, is formed by irradiating the substrate 5 with laser light in advance.

As described above, the plurality of groove portions 11*a* are arranged on the end surface 5*c* of the substrate 5, which is included by the heater 1 according to the embodiment, along the outer periphery of the substrate 5. The coefficient $A=100 \times D/(T \times P)$ satisfies $0.4 \leq A \leq 0.9$ where T [μm] is the thickness of the substrate 5, D [μm] is the depth of the groove portion 11*a* in the thickness direction of the substrate 5, and P [μm] is a pitch between the groove portions 11*a*. With the coefficient A satisfying $0.4 \leq A$, it is possible to suppress a variation in external dimension of the heater 1 (substrate 5) and is possible to enhance the processing accuracy of the external dimension of the heater 1. With the coefficient A satisfying $A \leq 0.9$, it is possible to secure suitable mechanical strength and thermal strength of the heater 1. Therefore, according to the heater 1, it is possible to suppress a variation in external dimension of the heater 1 and is possible to suppress a decrease in mechanical strength and thermal strength of the heater 1 without adding a processing process to a manufacturing process of the heater 1.

In addition, according to the heater 1, it is possible to suppress cracking occurring in the substrate 5 of the heater 1 when handling the heater 1 in a manufacturing process of the heater 1 or in a manufacturing process of an image forming apparatus which uses the heater 1 after splitting the base material into the plurality of heaters 1 without adding a processing process to a manufacturing process of the heater 1. Therefore, according to the heater 1, it is possible to suppress an increase in manufacturing cost of the heater 1 and the image forming apparatus.

Note that, in the substrate 5 illustrated in FIG. 1, the groove portions 11*a* are formed along a pair of long end surfaces 5*c*, which are parallel to each other, and no groove portion 11*a* is formed on a pair of short end surfaces 5*c*. However, the configuration is not limited to this. The groove portions 11*a* may be formed on the end surfaces 5*c* along the entire periphery of the substrate 5 according to arrangement (layout) of each substrate 5 for splitting the base material into the plurality of substrates 5.

Figure 7:
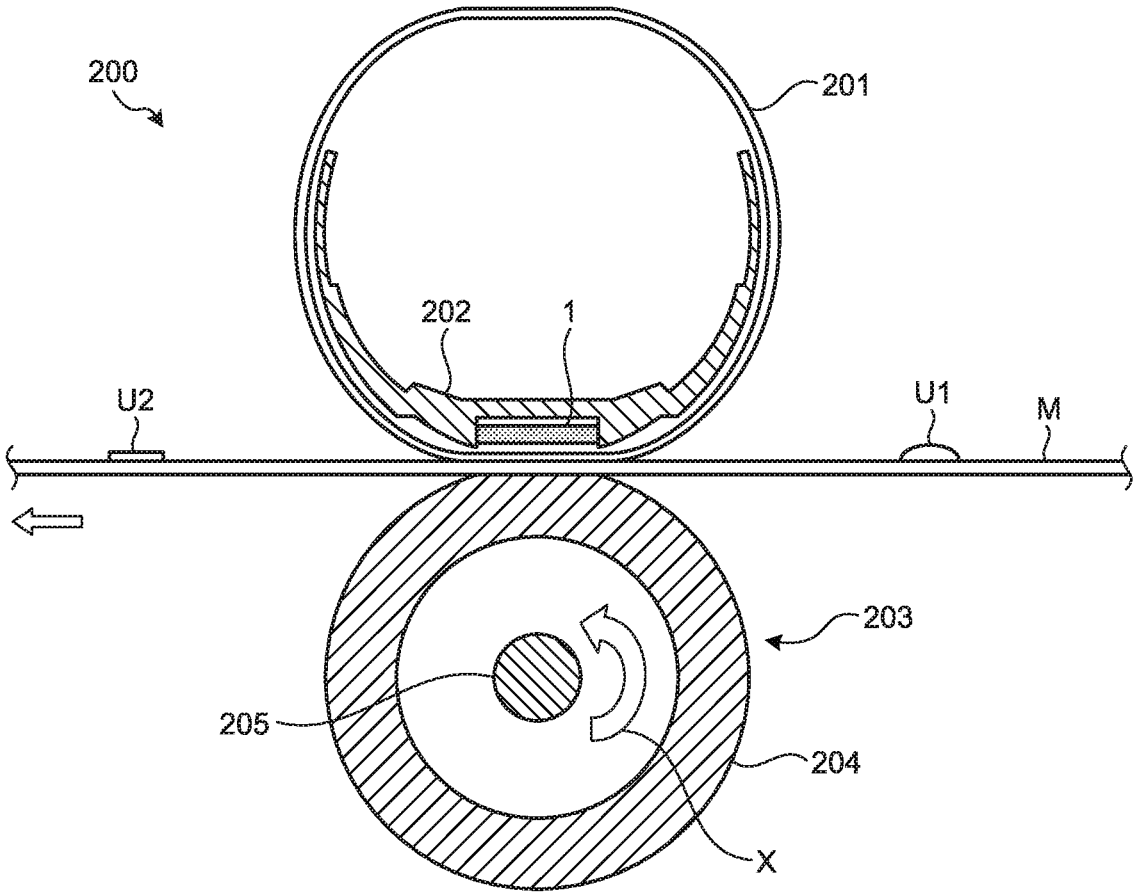
FIG. 7 is a sectional view illustrating an embodiment of a fixing device.

Next, a fixing device according to the embodiment, which uses the heater 1 according to the embodiment, will be described with reference to the drawings. FIG. 7 is a sectional view illustrating an embodiment of the fixing device which uses the heater 1 according to the embodiment. In a fixing device 200, the heater 1 is provided in a bottom portion of a fixing film belt 201 which is cylindrically wound around a supporting body 202. The fixing film belt 201 is formed of a resin material such as polyimide which has heat resistance. The pressure roller 203 is disposed at a position facing the heater 1 and the fixing film belt 201. The pressure roller 203 includes a heat resistant elastic material, for example, a silicone resin layer 204 in a surface thereof, and the pressure roller 203 can be rotated around a rotation shaft 205 (in direction X in FIG. 7) while being in pressure contact with the fixing film belt 201.

In a toner fixing process, on a contact surface between the fixing film belt 201 and the silicone resin layer 204, a toner image U1 that is adhered to the recording sheet (copying paper) M, which is a medium, is heated and melted by the heater 1 via the fixing film belt 201. As a result, at least a surface portion of the toner image U1 is softened and melted with the temperature thereof exceeding the melting point. Thereafter, the recording sheet M is separated from the heater 1 and is separated from the fixing film belt 201 in a position on a paper sheet discharging side of the pressure roller 203, and a toner image U2 is spontaneously solidified while radiating heat so that the toner image U2 is fixed onto the recording sheet M.

Figure 8:
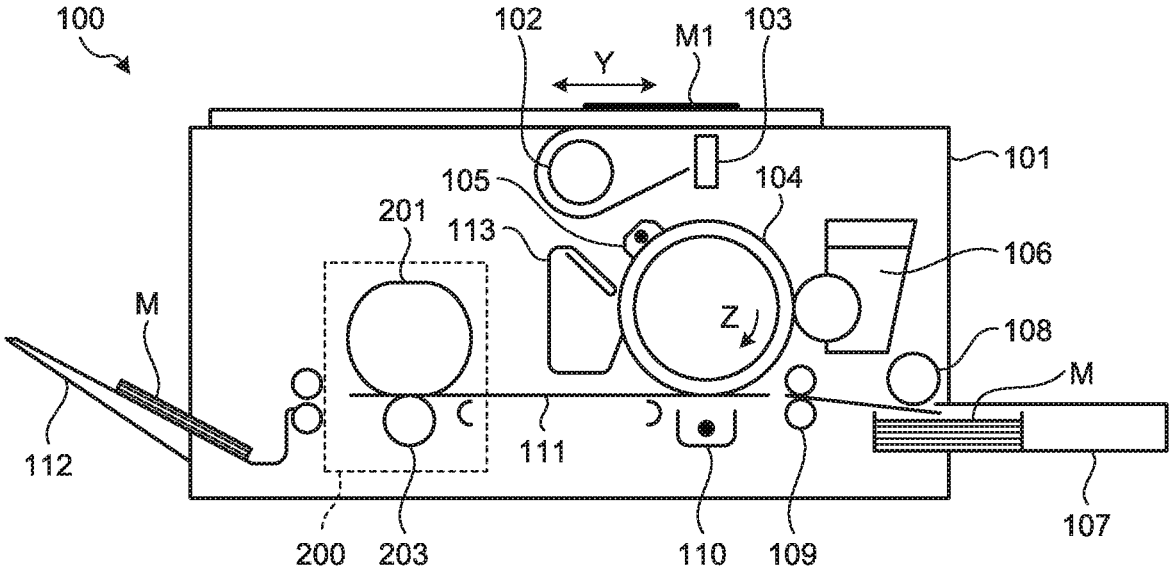
FIG. 8 is a sectional view illustrating an embodiment of an image forming apparatus.

Finally, the image forming apparatus according to the embodiment, which includes the heater 1 according to the embodiment, will be described with reference to the drawings. FIG. 8 is a sectional view illustrating an embodiment of the image forming apparatus which uses the heater 1 according to the embodiment. Note that, the image forming apparatus according to the embodiment is configured to function as the copying machine 100. As illustrated in FIG. 8, in the copying machine 100, constituent components, including the above-described fixing device 200, are provided in a housing 101. A document mounting table, which is formed of a transparent material such as glass, is attached onto an upper portion of the housing 101. The copying machine 100 has a configuration in which a document M1, from which image information is read, reciprocates (arrow Y illustrated in FIG. 8) on the document mounting table while being scanned.

A lighting device 102, which includes a lamp for irradiation with light and a reflecting mirror, is provided on the upper portion of the housing 101. Light emitted from the lighting device 102 is reflected on a surface of the document M1 on the document mounting table and is guided onto a photosensitive drum 104 via a short focus small diameter image forming element array 103 such that the photosensitive drum 104 is subjected to slit exposure. The photosensitive drum 104 is provided to be rotatable (direction Z in FIG. 8). In addition, a charging device 105 is provided in the vicinity of the photosensitive drum 104 which is disposed in the housing 101. The photosensitive drum 104 is evenly charged by the charging device 105. The photosensitive drum 104 is covered with, for example, a zinc oxide photosensitive layer or an organic semiconductor photosensitive layer. An electrostatic image after image exposure performed by the short focus small diameter image forming element array 103, is formed on the charged photosensitive drum 104. The electrostatic image is developed into a toner image by using a toner formed of resin or the like, which is softened and melted when being heated by a developing device 106.

The recording sheet M, accommodated in a cassette 107, is fed onto the photosensitive drum 104 by a pair of transportation rollers 109, which rotate in synchronization with a feeding roller 108 and the toner image on the photosensitive drum 104 while being in pressure contact with each other in a vertical direction. Then, the toner image on the photosensitive drum 104 is transferred onto the recording sheet M by a transferring discharger 110. Thereafter, the recording sheet M, which is fed to the downstream side from a position on the photosensitive drum 104, is guided to the fixing device 200 along a transportation guide 111 and is discharged onto a tray 112 after being subjected to a heating and fixing process (above-described toner fixing process). After the toner image is transferred to the recording sheet M, the toner remaining on the photosensitive drum 104 is removed by a cleaner 113.

In the fixing device 200, the heater 1 is provided in a state of being pressurized by the silicone resin layer 204, which is attached onto the outer periphery of the pressure roller 203. In the heater 1, the heating resistor 6 of an effective length corresponding to the width (length) of the largest sheet on which the copying machine 100, can perform a copying operation, that is, the heating resistor 6, which is longer than the width (length) of the largest sheet, is provided in the width direction of the recording sheet M, which is orthogonal to a transportation direction of the recording sheet M. In addition, a non-fixed toner image on the recording sheet M, being fed between the heater 1 and the pressure roller 203, is melted by being heated by the heating resistor 6 so that a copied image such as a character, a symbol, or an image appears on the recording sheet M.

An example, in which the heater 1 according to the embodiment is used as a fixing heater of the image forming apparatus such as the copying machine 100, is described above. However, the purpose of use of the heater 1 is not limited to this. The heater 1 according to the embodiment may be used as a heat source for heating or temperature control being mounted onto household electrical appliances, precision machines for business or experiment, equipment for chemical reaction, or the like.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A heater comprising:

a substrate that is formed of a heat resistant insulating ceramic material, and is provided with one main surface and an other main surface opposite to the one main surface;

a heating resistor that is provided on the one main surface of the substrate;

a conductor that is provided on the one main surface of the substrate and that is electrically connected to the heating resistor; and a coating film that covers the heating resistor and the conductor, wherein a plurality of grooves are formed on an end surface of the substrate in a direction from the other main surface to the one main surface, and are arranged along an outer periphery of the substrate, and wherein a coefficient $A=100\times D/(T\times P)$ satisfies $0.4\leq A\leq 0.9$ where T [μm] is the thickness of the substrate, D [μm] is the depth of the groove in a thickness direction of the substrate, and P [μm] is a pitch between the plurality of grooves, wherein the plurality of grooves satisfies $(D/T)\times 100\leq 31$.

2. An image forming apparatus comprising:

the heater according to claim 1 that heats a medium; and a pressure roller that pressurizes the medium which is heated by the heater, wherein a toner, which is adhered to the medium, is fixed by the heater and the pressure roller.

3. The heater according to claim 1, wherein material of the substrate is any one of alumina, aluminum nitride, or silicon nitride.

4. The heater according to claim 1, wherein the thickness T [μm] of the substrate is 500 [μm] to 1000 [μm].

5. A manufacturing method of a heater, comprising:

forming a heating resistor and a conductor, which is electrically connected to the heating resistor, on one main surface of a substrate, which has the one main surface and an other main surface opposite to the one main surface and which is formed of a heat resistant insulating ceramic material, and covering the heating resistor and the conductor with a coating film;

forming a plurality of grooves in a direction from the other main surface to the one main surface, and forming a groove line, in which the plurality of grooves are arranged, by irradiating the other main surface of the substrate with laser light; and splitting the substrate along the groove line, wherein a groove in which a coefficient $A=100\times D/(T\times P)$ satisfies $0.4<A<0.9$ is formed in the forming of the groove line where T [pm] is the thickness of the substrate, D [pm] is the depth of the groove in a thickness direction of the substrate, and P [pm] is a pitch between the grooves, wherein the plurality of grooves satisfies $(D/T)\times 100\leq 31$.

* * * * *